US005411042A

United States Patent [19]

Suzuki et al.

[11] Patent Number: 5,411,042

[45] Date of Patent: May 2, 1995

[54] DISH WASHING MACHINE

[75] Inventors: Hajime Suzuki; Kousaku Kataoka, both of Otsu; Katsuji Oonishi, Kyoto, all of Japan

[73] Assignee: Sanyo Electric Co., Ltd., Japan

[21] Appl. No.: 109,505

[22] Filed: Aug. 20, 1993

[51] Int. Cl.[6] ..... A47L 15/46

[52] U.S. Cl. ..... 134/57 D; 68/12.02; 134/95.2; 134/105

[58] Field of Search ..... 134/57 D, 95.2, 105, 134/108; 68/12.02

[56] References Cited

U.S. PATENT DOCUMENTS

| | | | |
|---|---|---|---|
| 5,048,139 | 9/1991 | Matsumi et al. | 68/12.02 X |
| 5,105,635 | 4/1992 | Kiuchi et al. | 68/12.02 X |
| 5,140,842 | 8/1992 | Kuichi et al. | 68/12.02 |
| 5,172,572 | 12/1992 | Ono | 68/12.02 |
| 5,241,845 | 9/1993 | Ishibashi et al. | 68/12.02 |
| 5,265,446 | 11/1993 | Kuroda et al. | 68/12.02 |

FOREIGN PATENT DOCUMENTS 49584 3/1993 Japan .

*Primary Examiner*—Philip R. Coe

*Attorney, Agent, or Firm*—Beveridge, DeGrandi, Weilacher & Young

[57] ABSTRACT

A dish washing and drying machine according to the present invention determines the sequence of washing conforming the amount of dirt and the quality of dirt on the dishes and executes the same. This dish washing and drying machine finds the amount of dirt from a value MF stored in a buffer MF 47 storing transmittance detected by a transmittance detecting circuit 41. In this case, an output is corrected by a value ME stored in a buffer ME 46 and a reference voltage, to correct the amount of degradation of a light receiving element. In addition, the quality of dirt is found from a value MD stored in a buffer MD 45 and a value MC stored in a buffer MC 44. The sequence of processing is determined from the amount of dirt and the quality of dirt. Accordingly, washing can be done depending on not only the amount of dirt but also the quality of dirt, for example, whether dirt is caused by oil, proteins or the like. As a result, it is possible to sufficiently and completely wash the dishes.

20 Claims, 16 Drawing Sheets

DISH WASHING MACHINE

CROSS REFERENCE TO RELATED APPLICATION

The disclosure of Japanese Patent Application Serial No. 4-20042 is incorporated by reference.

BACKGROUND OF THE INVENTION

1. Field of the Invention

The present invention relates to a dish washing machine and a dish washing and drying machine for automatically, for example, washing, rinsing, and dehydrating the drying dishes contained in a cavity.

2. Description of the Prior Art

A dish washing and drying machine so adapted as to spray wash water on the dishes contained in a cavity to wash the dishes and dry the dishes which have been washed in the cavity is known and is disclosed in, for example, Japanese Patent Laid-Open Gazette No. 48724/1985.

A conventional dish washing and drying machine is so constructed that at least a part of the sidewall of a water suction pipe provided between a water storage chamber provided on the bottom of a cavity and the water suction side of a nozzle pump is made of a translucent material, and a light emitting element and a light receiving element for detecting the light transmittance of a liquid in the water suction pipe are disposed on the outside of the translucent sidewall, to control the termination of each of the washing, rinsing, dehydrating and drying processes at the time point where the amount of light received by the light receiving element is not changed.

Meanwhile, dirt on the dishes to be washed by the dish washing and drying machine is not uniform. Accordingly, it is desirable to change how to wash the dishes depending on the type of dirt.

Although it is generally desirable that oily dirt is removed by increasing the temperature of wash water to soften the oil, dirt by proteins such as albumin in eggs must be removed with low-temperature wash water because it solidifies at high temperatures (not less than 60° C.).

In the conventional dish washing and drying machine, however, washing process control corresponding to the quality of dirt, such as oily dirt or dirt by proteins is not carried out. In the conventional dish washing and drying machine, therefore, an oil film may remain or a residue of eggs or the like may remain stuck on the dishes which have been washed.

Furthermore, the conventional dish washing and drying machine has the disadvantage in that light transmittance proportional to the condition of dirt of wash water itself cannot, in some cases, be detected. The following are the reasons. A detergent dissolves in the wash water in the washing process. Accordingly, bubbles of the detergent are formed if the wash water is agitated at the time of washing. In addition, if air is mixed with the wash water during the circulation of the wash water, cavitation is encountered, to form fine bubbles. The bubbles change the light transmittance of the wash water. Therefore, the light transmittance of the wash water itself may not, in some cases, be accurately detected.

Furthermore, garbage debris dropped from the dishes is suspended in the wash water during the washing operation. Accordingly, the garbage may, in some cases, cross between the light emitting element and the light receiving element, thereby preventing light transmittance of the wash water from being detected.

SUMMARY OF THE INVENTION

An object of the present invention is to provide a dish washing machine and/or a dish washing and drying machine so improved as to wash the dishes depending on not only the amount of dirt but also the quality of the dirt.

Another object of the present invention is to provide a dish washing machine so improved that the light transmittance of wash water itself can be correctly detected in order to detect the amount of dirt and the quality of dirt.

A dish washing machine according to the present invention respectively detects the light transmittance (first transmittance, second transmittance, and third transmittance) of wash water before the washing operation is started, when a predetermined short time period has elapsed since the washing operation was started, and at a certain time point after the washing operation is further performed after an elapse of the short time period. As a result, the lower one of the second transmittance and the third transmittance is judged to be the amount of dirt. In this case, a detected value from the transmittance detecting means is preferably corrected using the first transmittance. In addition, the quality of the dirt is judged on the basis of the difference between the second transmittance and the third transmittance. Also, the detected value is preferably corrected using the first transmittance.

In control means, the sequence of washing and rinsing after detecting the third transmittance is controlled on the basis of the amount of dirt and the quality of dirt which are judged in the above described manner.

In the present invention, therefore, the washing and rinsing process may be changed depending on whether or not much of dirt is caused by oil, that is, the quality of dirt, thereby to make it possible to do washing conforming to the quality of dirt.

Furthermore, in accordance with another aspect of the present invention, an operation of feeding wash water by water feeding means can be stopped based on detecting when the light transmittance of the wash water is detected by transmittance detecting means. When the light transmittance is detected, therefore, bubbles formed in the wash water by the water feeding operation disappear, and garbage which is suspended in the wash water sinks. Accordingly, it is possible to correctly detect the light transmittance of the wash water.

Additionally, in accordance with another aspect of the present invention, a dish washing machine comprises a dish washing and drying machine having a dish drying function.

The foregoing and other objects, features, aspects and advantages of the present invention will become more apparent from the following detailed description of the present invention when taken in conjunction with the accompanying drawings.

DETAILED DESCRIPTION OF THE PREFERRED EMBODIMENTS

Figure 1:
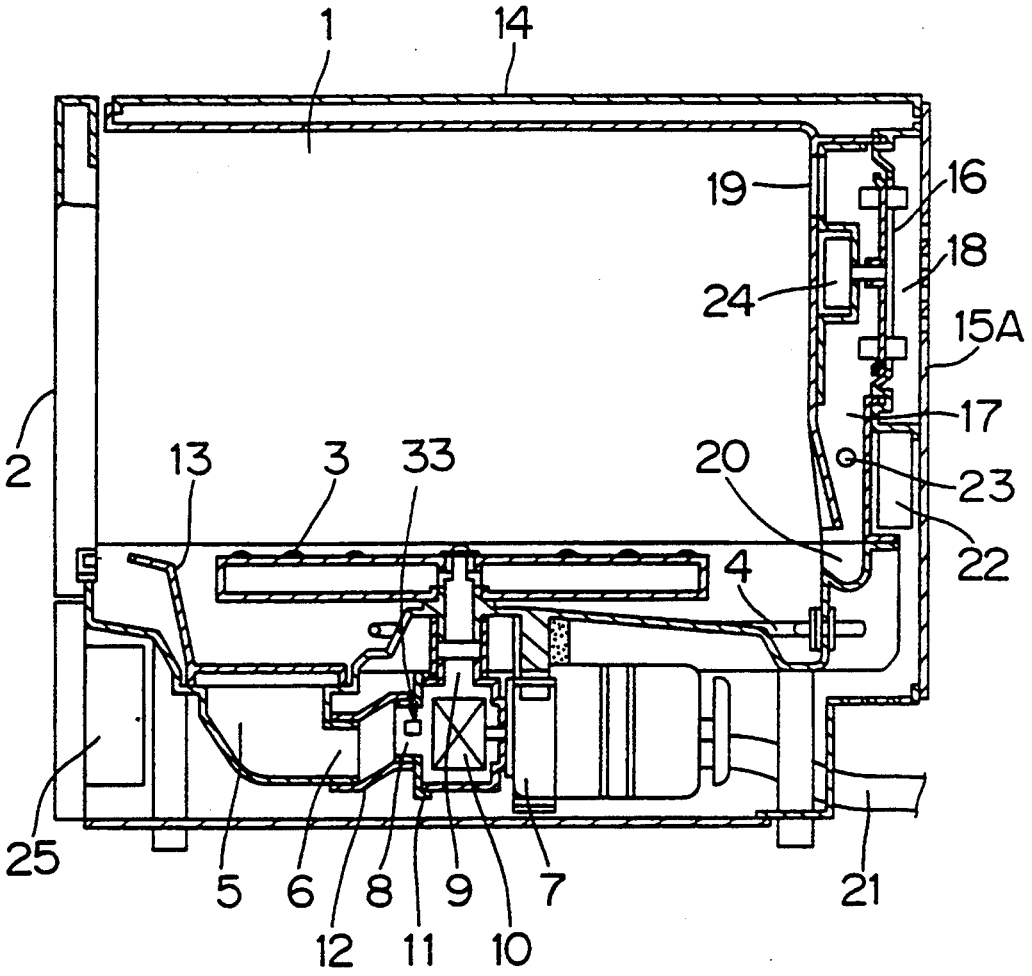
FIG. 1 is a longitudinal sectional view showing the entire construction of a dish washing and drying machine according to one embodiment of the present invention.

FIG. 1 is a longitudinal sectional view showing a dish washing and drying machine according to one embodiment of the present invention.

Referring to FIG. 1, a dish washing and drying machine according to the present embodiment comprises a cavity 1 for containing the dishes, a nozzle 3 rotatably attached to the center of a bottom surface of the cavity 1, a water supply valve 22 provided on a rear surface of the cavity 1 for supplying wash water to the cavity 1, a pump 7 mounted on an outer bottom surface of the cavity 1 for feeding the wash water into the nozzle 3 to spray the wash water on the dishes, a heater 4 disposed on the bottom surface of the cavity 1 for heating the wash water in the cavity 1, a transmittance detecting device 33 for detecting the light transmittance of the wash water, and a control section 25 for controlling the sequence of washing, rinsing and drying.

The cavity 1 is formed in the shape of a box having an opening for accessing the dishes through a front surface. A door 2 for closing the opening is attached to a front portion of the cavity 1 so as to be freely opened or closed. In addition, the cavity 1 is covered by an outer tank casing 14. A water storing section 5 is formed in a front portion of the bottom of the cavity 1. A filter 13 for removing garbage contained in the wash water is disposed above the water storing section 5, and a discharge port 6 for discharging the wash water is provided on the bottom of the water storing section 5 to the side thereof.

A rear face plate 15A is attached to the rear of the outer tank 14 spaced a predetermined distance apart from the rear surface of the cavity 1. A circulating air duct 17 and a cooling air duct 18 partitioned by a double faced fan 16 are provided between the rear face plate 15A and the cavity 1. The double faced fan 16 is rotated by a motor 24. The circulating air duct 17 is formed in communication with an air outlet 19 provided in the upper portion of the rear surface of the cavity 1 and an air inlet 20 provided in the lower portion thereof. Air in the cavity 1 is forcibly exhausted from the air outlet 19 to the circulating air duct 17 by the double faced fan 16. Furthermore, air heat-exchanged and dehumidified is taken in to the cavity 1 from the air inlet 20 by the double faced fan 16.

The water supply valve 22 is connected to a water supply port 23 provided for the circulating air duct 17.

The pump 7 comprises a pump casing 11 having an inlet 8, an outlet 9 and an impeller 10. The pump 7 functions as a washing pump and a drainage pump. Specifically, the pump 7 feeds the wash water into the nozzle 3 from the outlet 9 of the pump casing 11 when it is rotated in the forward direction, to spray the wash water to the dishes in the cavity 1. On the other hand, the pump 7 drains the wash water in the cavity 1 outward through a drainage pipe 21 when it is rotated in the reverse direction. In addition, the position of the inlet 8 of the pump casing 11 is set higher than the discharge port 6 of the water storing section 5 by, for example, 15 mm, so that the step is provided between the inlet 8 and the discharge port 6.

The inlet 8 and the discharge port 6 of the water storing section 5 are connected to each other by a pipe 12 made of rubber. Although the pump 7 is a washing and drainage pump in the present embodiment, a washing pump and a drainage pump may be separately provided.

Figure 2:
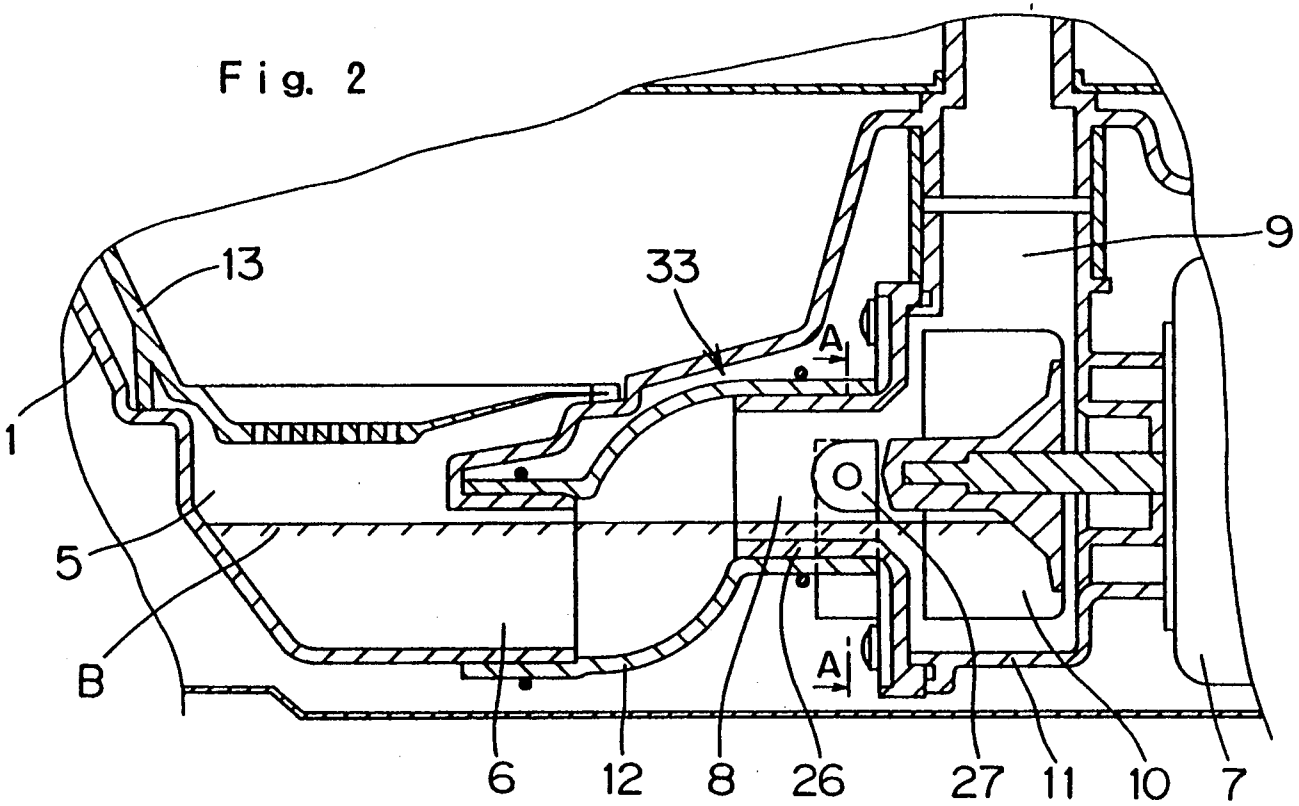
FIG. 2 is a enlarged sectional view showing the bottom of a cavity of the dish washing and drying machine according to one embodiment of the present invention.

FIG. 2 is a partially enlarged view showing the bottom of the cavity in the dish washing and drying machine shown in FIG. 1. In addition, FIG. 3 is a cross sectional view taken along a line A—A shown in FIG. 2.

Figure 3:
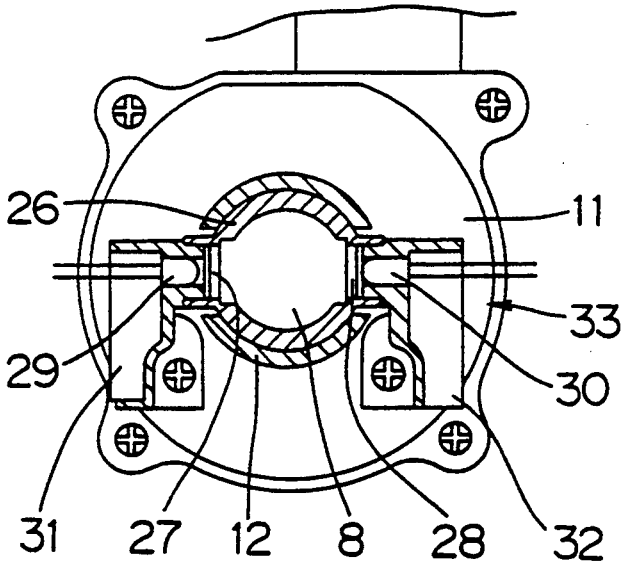
FIG. 3 is a cross sectional view taken along a line A—A shown in FIG. 2.

Referring to FIGS. 2 and 3, the transmittance detecting device 33 comprises an emitted light transmitting section 27 provided on a left side wall of a connecting section 26 for the pipe 12 provided for the inlet 8 of the pump casing 11 as viewed toward the inlet 8 and made of a transparent member, a light receiving section 28 provided on a right side wall of the connecting section 26 so as to be opposed to the emitted light transmitting section 27 and made of a transparent member, a light emitting element 29 such as a diode for emitting light to the inlet 8 through the emitted light transmitting section 27, a light receiving element 30 such as a phototransistor for receiving the light emitted from the light emitting element 29 through the received light receiving section 28, a light emitting element mounting section 31 screwed into the pump casing 11 so as to fix the light emitting element 29 to the emitted light transmitting section 27 of the connecting section 26, and a light receiving element mounting section 32 screwed into the pump casing 11 so as to fix the light receiving element 30 to the light receiving section 28.

The dish washing and drying machine according to the present invention is so constructed that the inlet 8 of the pump casing 11 is opened sideward so as to keep the height thereof small. If wash water is drained to some extent, air is mixed with the wash water sucked in by the pump 7, thereby to enter a state where the wash water cannot be further drained. The wash water which cannot be drained remains in the water storing section 5, the pipe 12, and the pump casing 11. At this time, the pump 7 is so attached that the inlet 8 of the pump casing 11 is higher than the discharge port 6 of the water storing section 5, whereby the surface of the remaining water is in a position indicated by B in FIG. 2. Consequently, the emitted light transmitting section 27 and the light receiving section 28 are above the surface of the remaining water B, not to be dipped in the remaining water and not to be clouded due to dirt in the remaining water. In addition, there is no degradation of light transmission properties due to the adhesion of water scale.

Figure 4:
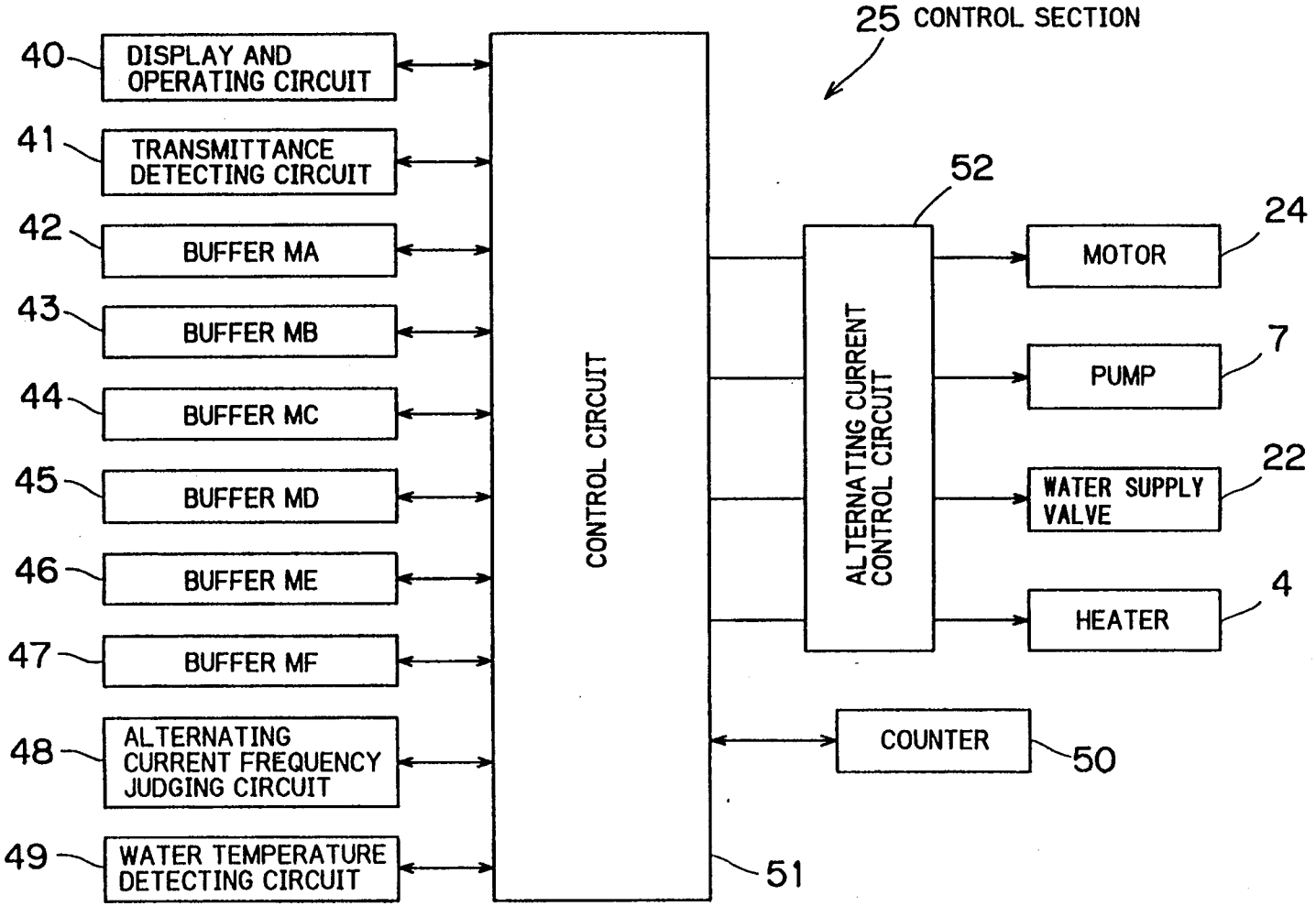
FIG. 4 is a block diagram showing an electric circuit for the dish washing and drying machine according to one embodiment of the present invention.

The electrical construction of the control section 25 will be described with reference to a block diagram of FIG. 4.

The control section 25 comprises a display and operating circuit 40, a transmittance detecting circuit 41 for detecting light transmittance on the basis of an output signal from the light receiving element 30 in the transmittance detecting device 33, a buffer MA 42, a buffer MB 43, a buffer MC 44, a buffer MD 45, a buffer ME 46 and a buffer MF 47 which store values detected by the transmittance detecting circuit 41, an alternating current frequency judging circuit 48 for judging the frequency of the commercial power supply, a water temperature detecting circuit 49 for detecting the temperature of wash water on the basis of an output signal from a temperature-sensing element such as a thermistor, a counter 50 for counting washing time, rinsing time and drying time, and a control circuit 51. The control circuit 51 has a microcomputer including a CPU, a ROM, a RAM and the like. A heater 4, a pump 7, a water supply valve 22 and a motor 24 are connected to the control circuit 51 through an alternating current control circuit 52. The control circuit 51 controls the motor 24, the pump 7, the water supply valve 22, and the heater 4 on the basis of the values detected by the transmittance detecting circuit 41.

The operation of the dish washing and drying machine according to the present embodiment will be described with reference to flow charts of FIGS. 5 through 12.

Figure 5:
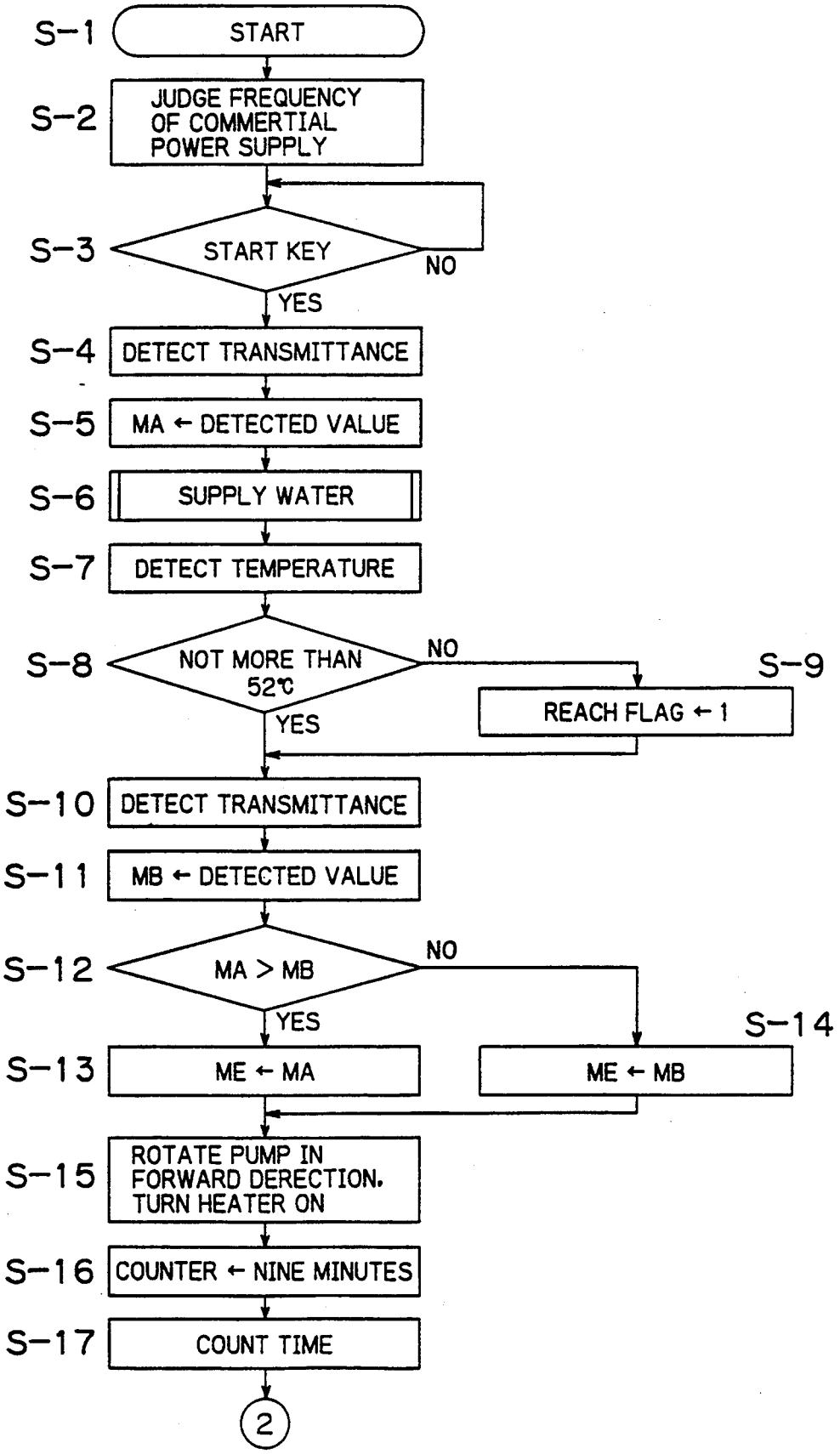
FIGS. 5, 6 and 7 are flow charts showing operations in the washing process in the dish washing and drying machine according to one embodiment of the present invention.
Figure 6:
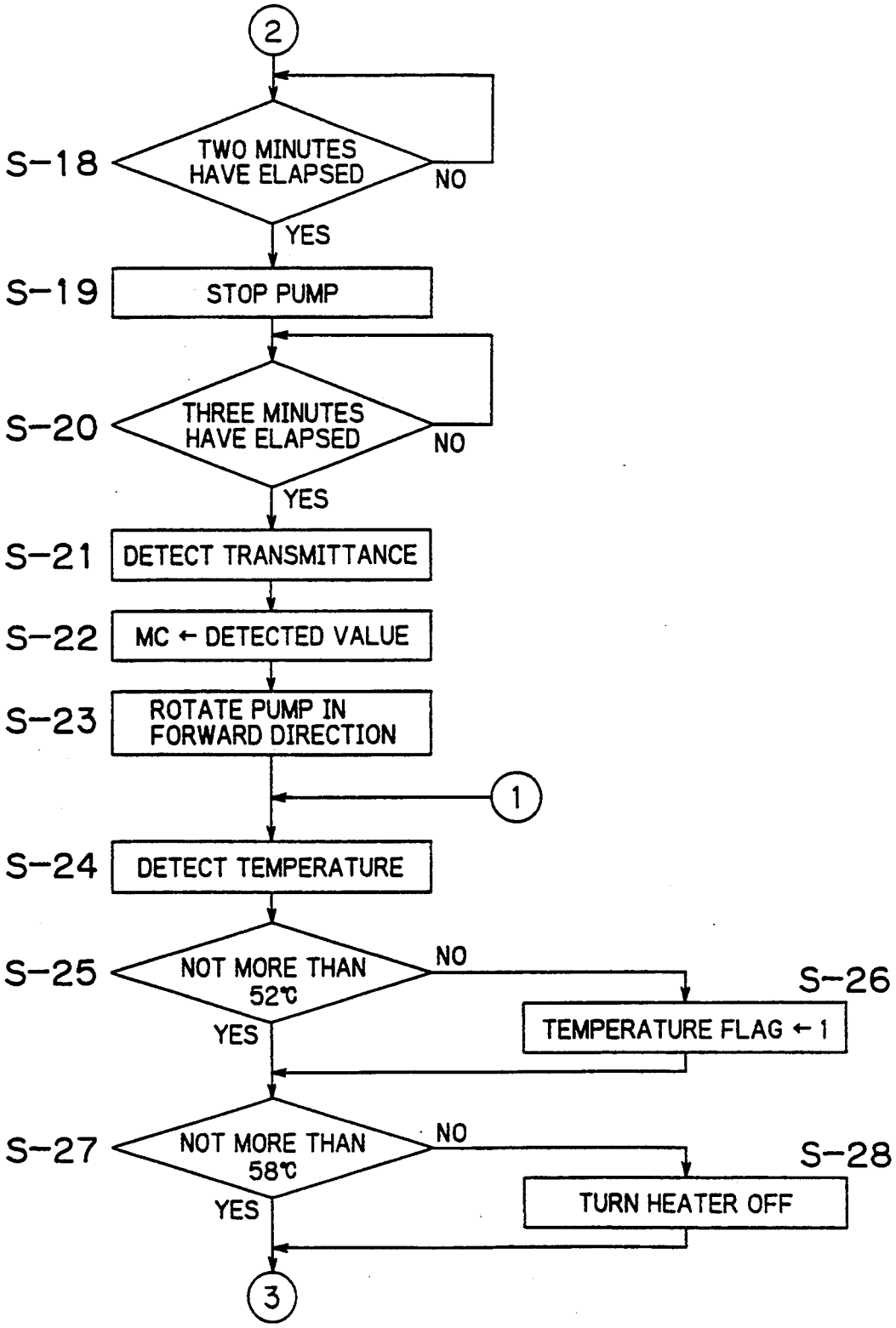
Figure 7:
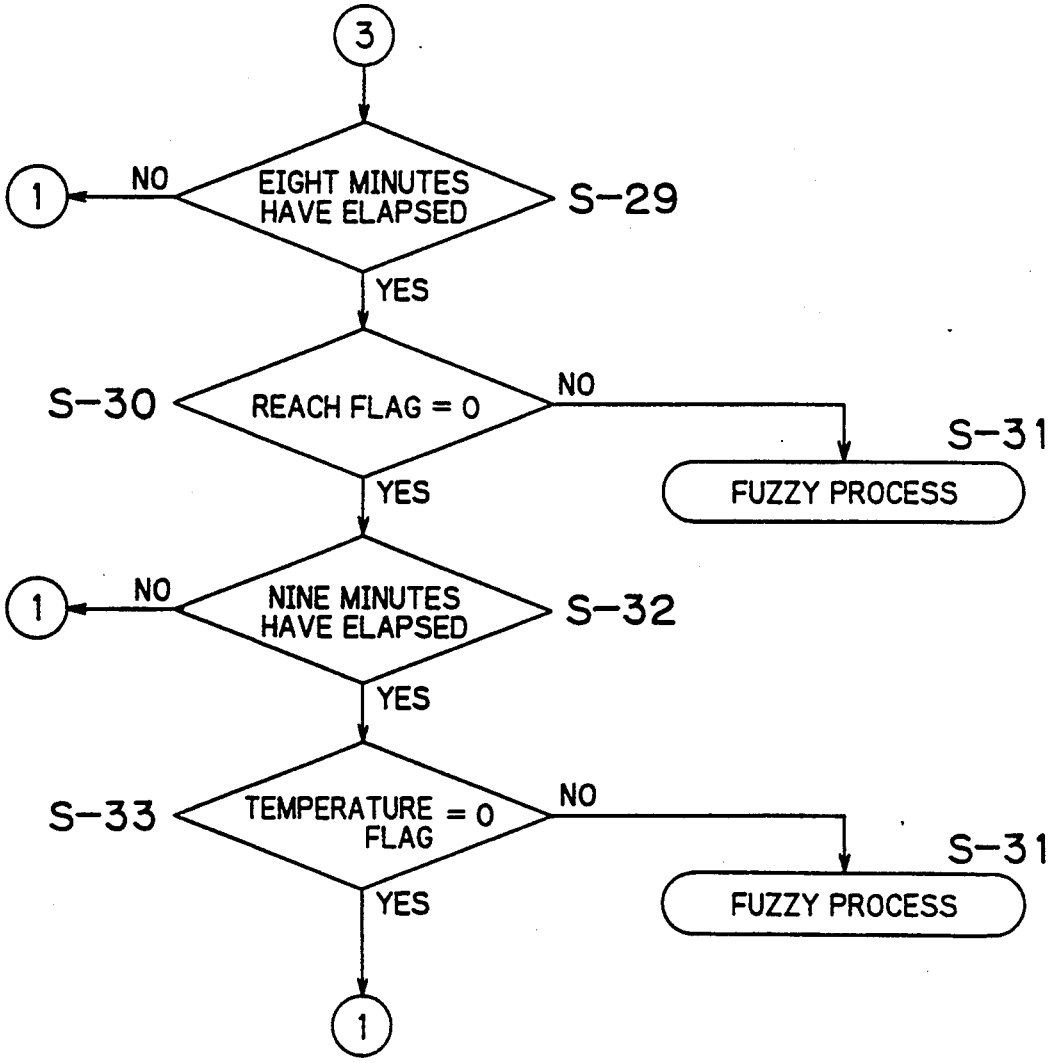
Figure 8:
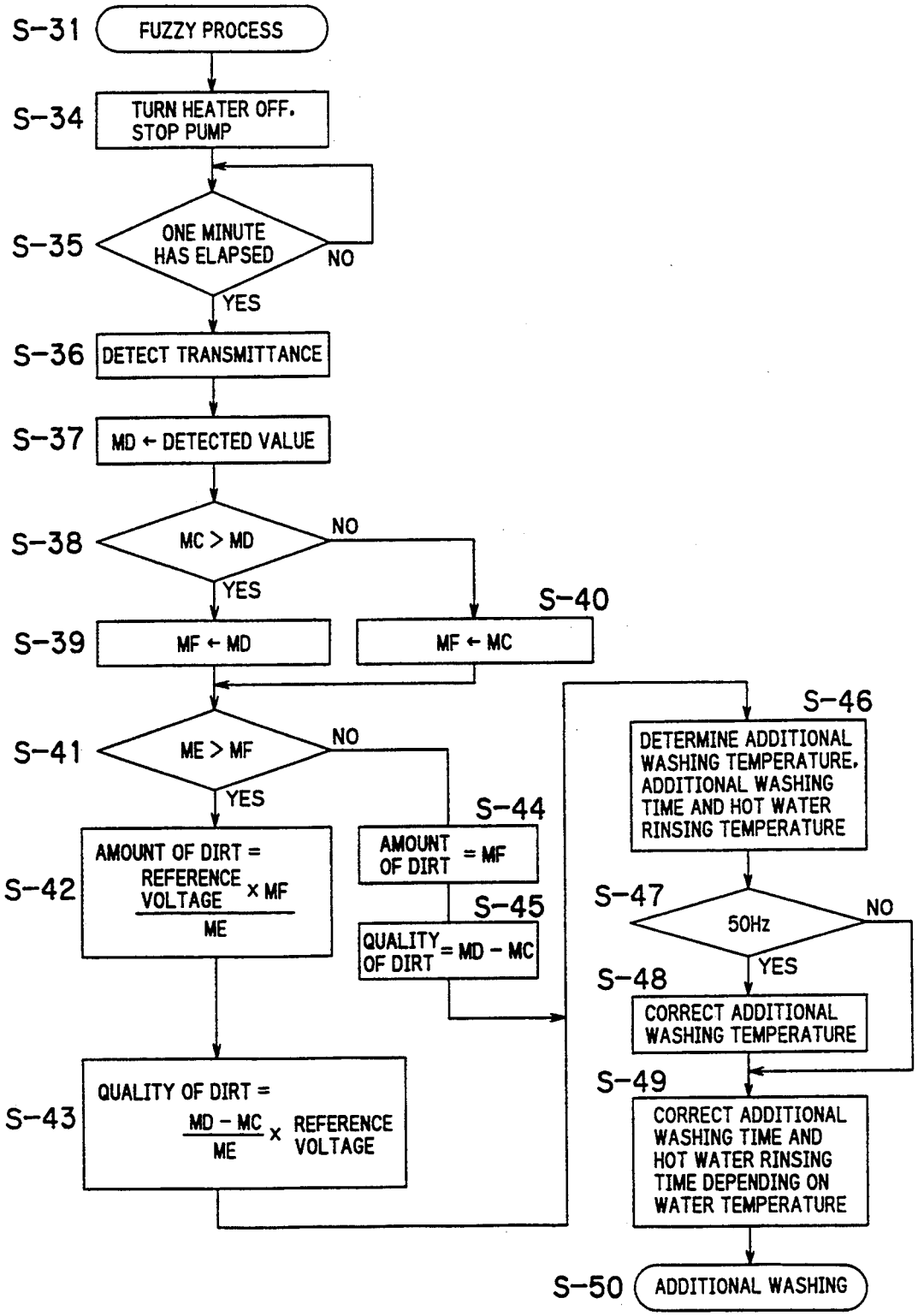
FIG. 8 is a flow chart showing operations of determining and correcting the sequence in a case where the dish washing and drying machine according to one embodiment of the present invention carries out fuzzy logic control.
Figure 9:
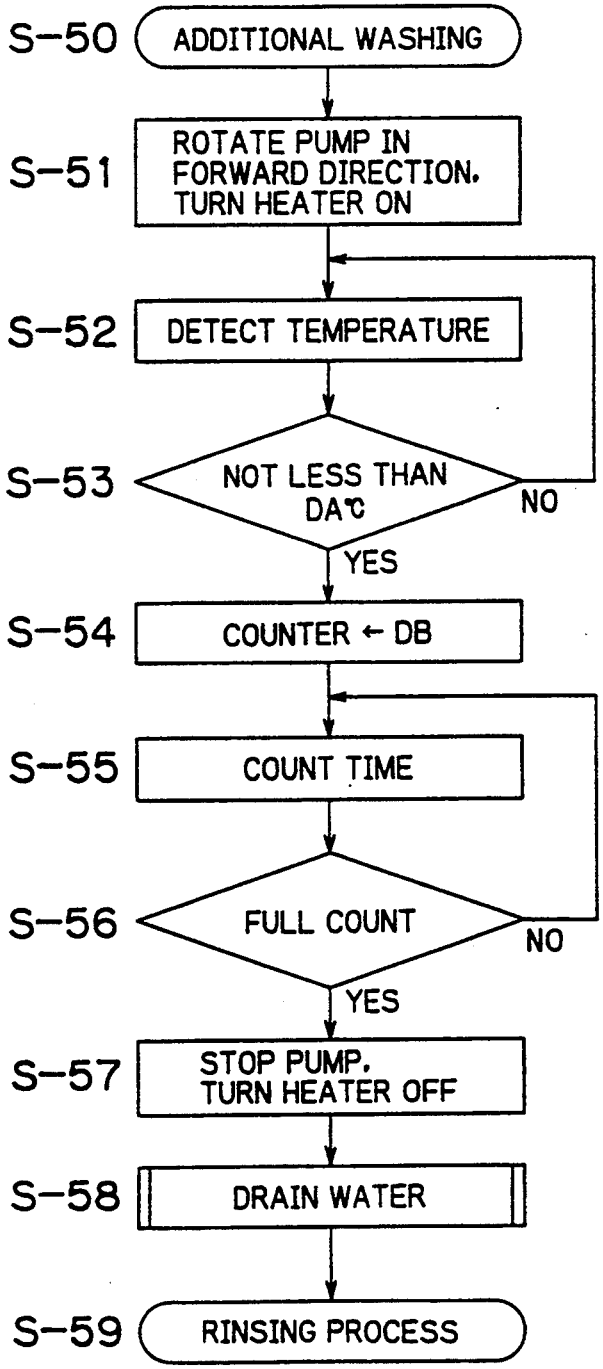
FIG. 9 is a flow chart showing operations in the additional washing process in the dish washing and drying machine according to one embodiment of the present invention.
Figure 11:
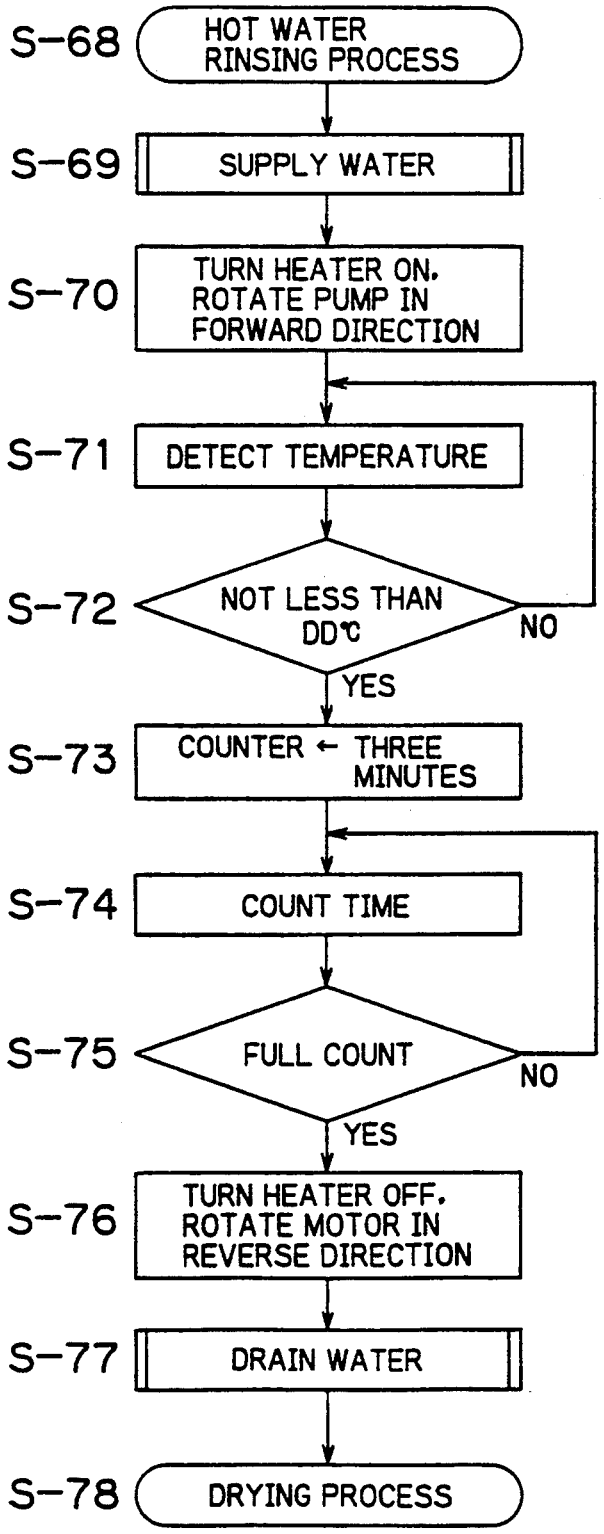
FIG. 11 is a flow chart showing operations in the hot water rinsing process in the dish washing and drying machine according to one embodiment of the present invention.
Figure 12:
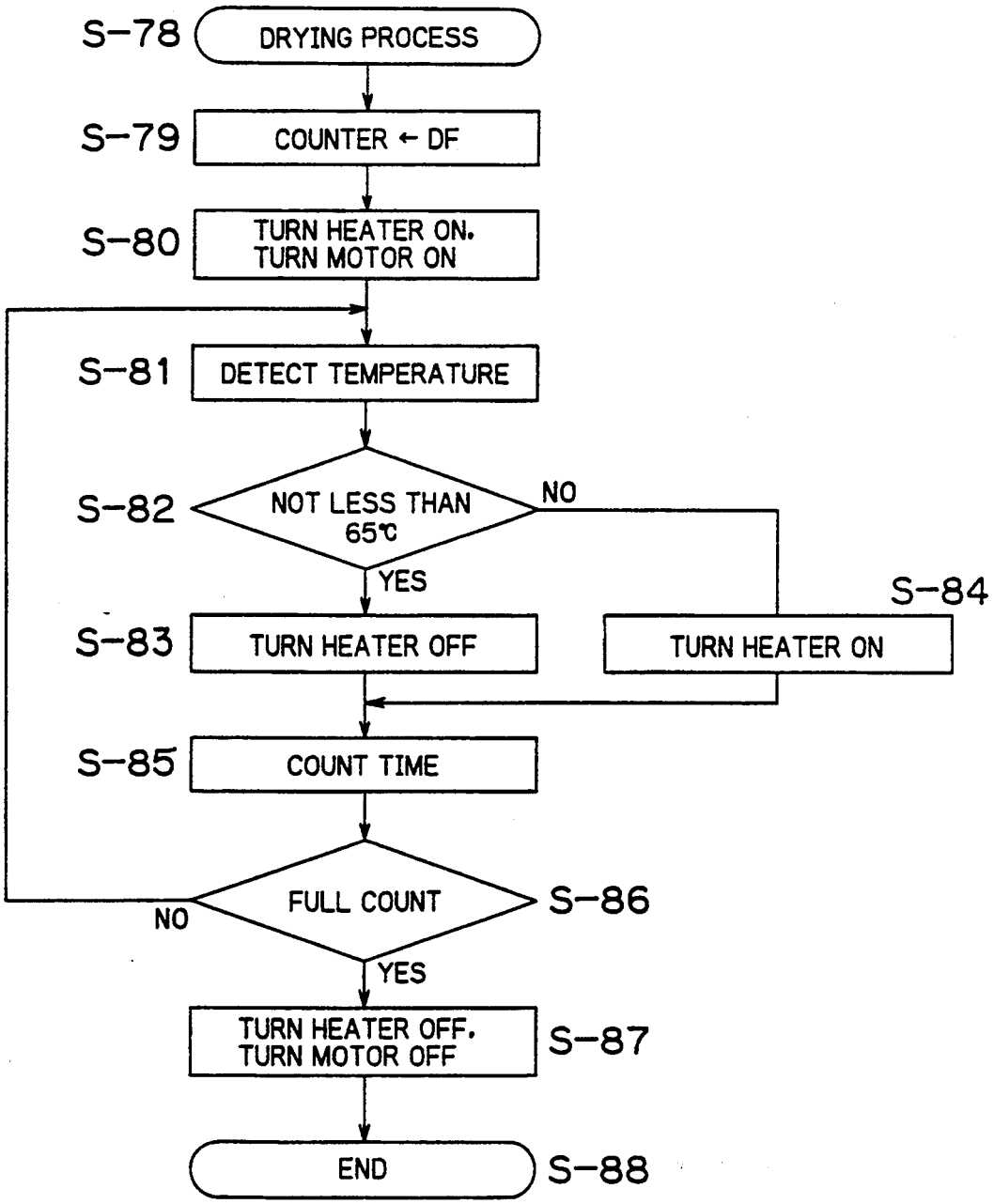
FIG. 12 is a flow chart showing operations in the drying process in the dish washing and drying machine according to one embodiment of the present invention.

FIG. 5 is a flow chart showing operations in the washing process, FIG. 6 is a flow chart showing operations subsequent to FIG. 5, FIG. 7 is a flow chart showing operations subsequent to FIG. 6, FIG. 8 is a flow chart showing operations for determining and correcting the sequence in the fuzzy logic process, FIG. 9 is a flow chart showing operations in the additional washing process, FIG. 11 is a flow chart showing operations in the hot water rinsing process, and FIG. 12 is a flow chart showing operations in the drying process.

If the operation is started in the step S-1 shown in FIG. 5, the frequency of the commercial power supply is judged by the alternating current frequency judging circuit 48 in the step S-2 and then, the program proceeds to the step S-3. If it is judged in the step S-3 that a start key is operated, the transmittance is detected by the transmittance detecting circuit 41 on the basis of an output signal from the light receiving element 30 in the step S-4. Specifically, the transmittance before the water supply to the cavity 1 is detected (this detected value is outputted as a voltage, which is, for example, 5V if the condition is normal). The value before the water supply which is detected in the step S-4 is stored in the buffer MA 42 in the step S-5 and then, the water supply valve 22 is opened to supply a predetermined amount of wash water to the cavity 1 in the step S-6. If the predetermined amount of wash water is supplied, the program proceeds to the step S-7. In the step S-7, the temperature of the supplied wash water is detected by the water temperature detecting circuit 49. At this time, if the detected temperature is not more than 52° C., the program proceeds to the step S-10. On the other hand, if the temperature exceeds 52° C., a reach flag is set to "1" in the step S-9 and then, the program proceeds to the step S-10. Since it is generally water at ordinary temperature that is supplied to the cavity 1, the step S-9 is skipped in many cases.

If the program proceeds to the step S-10, the light transmittance of the wash water is detected by the transmittance detecting circuit 41. Specifically, the light transmittance of the wash water before the start of the washing operation is detected. The transmittance before the start of the washing operation is generally approximately equal to the transmittance before the water supply, that is, approximately 5V. The value before the start of the washing operation is stored in the buffer MB 43 in the step S-11.

In the step S-12, the value MA before the water supply which is stored in the buffer MA 42 and the value MB before the start of the washing operation after the water supply which is stored in the buffer MB 43 are compared with each other. The value MA is stored in the buffer ME 46 in the step S-13 if MA>MB, while the value MB is stored in the buffer ME 46 in the step S-14 if MA<MB. Specifically, the higher one of the first transmittance MA which is detected in the step S-4 and the transmittance MB before the start of the washing operation after the water supply which is detected in the step S-10 is stored in the buffer ME 46 as an initial value in the steps S-13 and S-14 and then, the program proceeds to the step S-15.

In the present embodiment, 5V is outputted as a voltage representing the initial transmittance in a case where the condition of dirt of the wash water is normal from the transmittance detecting device 33. As described above, the value MA before the water supply which is detected in the step S-4 and the value MB before the start of the washing operation after the water supply which is detected in the step S-10 are approximately equal to each other, that is, 5V, so that the transmittance is approximately 100%. Therefore, both the values MA and MB are hardly changed.

However, garbage at the time of the previous washing may, in some cases, adhere to a light path from the light emitting element 29 to the light receiving element 30 in the transmittance detecting device 33. In such a case, the value MA before the water supply which is detected in the step S-4 is extremely low. If the wash water is supplied to the cavity 1, however, the garbage is suspended in the wash water, so that no garbage is left in the light path from the light emitting element 29 to the light receiving element 30 in many cases. Accordingly, a normal value, for example, 5V is obtained as MB in the step S-10. On the other hand, the value MA which is detected in the step S-4 is 5V. However, the garbage may, in some cases, accidentally intercept the light received by the light receiving element 30 by supplying the wash water so that the value MB which is detected in the step S-10 is significantly lowered.

In the present embodiment, the transmittance before the water supply and the transmittance before the start of the washing operation after the water supply are detected to select the correct one, that is, the higher one of values of the transmittance in consideration of such a phenomenon sometimes occurring that garbage intercepts light.

Furthermore, the light emitting element 29 or the light receiving element 30 in the transmittance detecting device 33 is gradually degraded in performance as it is used. Therefore, the value which is detected in the step S-4 or the value which is detected in the step S-10 is gradually lowered due to the change with time even if light is not intercepted by garbage or the like. When the amount of dirt and the quality of dirt are calculated as described below, the above described value detected in the step S-4 or S-10 is utilized so as to compensate for the degradation with the use.

The pump 7 is rotated in the forward direction so that the washing operation is started and the heater 4 is turned on in the step S-15, time data "nine minutes" is inputted to the counter 50 in the step S-16, and time starts to be counted in the step S-17. Thereafter, the program proceeds to the steps in FIG. 6.

It is judged in the step S-18 whether or not two minutes have elapsed since the washing operation was started. If two minutes have elapsed since the washing operation was started, the program proceeds to the step S-19. In the step S-19, the pump 7 is stopped. In addition, it is judged in the step S-20 whether or not three minutes have elapsed since the washing operation was started. If three minutes have elapsed since the washing operation was started, that is, one minute has elapsed since the pump 7 was stopped, the program proceeds to the step S-21. In the step S-21, the light transmittance of the wash water is detected by the transmittance detecting circuit 41. In the step S-22, the value detected in the step S-21 is stored in the buffer MC 44. The pump 7 is then rotated in the forward direction again in the step S-23 and then, the program proceeds to the step S-24.

The reason why the pump 7 is stopped in detecting the light transmittance of the wash water after the washing operation is started in the above described steps S-18 through S-23 is as follows.

If the light transmittance is detected with the pump 7 being driven, there are the following possibilities:

a) At the time of washing, a detergent is contained in the wash water. If the wash water is agitated by driving the pump 7, bubbles of the detergent are formed. In addition, if air is taken in while the pump 7 is being driven and consequently, the air is contained in the wash water, and cavitation is encountered, to form bubbles. The formation of the bubbles makes it impossible to accurately detect the light transmittance of the wash water itself.

b) While the pump 7 is being driven, the wash water is agitated, and garbage or the like dropped from the dishes is suspended in the wash water. Accordingly, the garbage or the like interrupts light between the light emitting element 29 and the light receiving element 30 in the transmittance detecting device 33, thereby making it impossible to accurately detect the light transmittance of the wash water itself.

In the present embodiment, therefore, the light transmittance of the wash water is detected after the pump 7 is stopped one minute before the transmittance is detected, so that the bubbles in the wash water disappear and the garbage or the like sinks into the lower part of the wash water. Consequently, it is possible to accurately detect the condition of dirt of the wash water itself.

If the program proceeds to the step S-24, the temperature of the wash water is detected. In the step S-25, it is judged whether or not the temperature of the wash water is not more than 52° C. The program proceeds to the step S-27 if the temperature of the water is not more than 52° C., while a temperature flag is set to "1" in the step S-26 and then, the program proceeds to the step S-27 if the temperature exceeds 52° C. In the step S-27, it is judged whether or not the temperature of the wash water is not more than 58° C. The program proceeds to the step S-29 shown in FIG. 7 if the temperature of the water is not more than 58° C., while the heater 4 is turned off in the step S-28 and then, the program proceeds to the step S-29 if the temperature exceeds 58° C.

If the program proceeds to the step S-29, it is judged whether or not eight minutes have elapsed since the washing operation was started. If eight minutes have elapsed since the washing operation was started, the program proceeds to the step S-30. In the step S-30, the reach flag is detected. The program proceeds to the fuzzy process in the step S-31 if the reach flag is set to "1", that is, the supplied wash water exceeds 52° C., while proceeding to the step S-32 if the reach flag is "0". In the step S-32, it is judged whether or not one minute has further elapsed, that is, nine minutes have elapsed since the washing operation was started. If nine minutes have elapsed since the washing operation was started, the program proceeds to the step S-33. In the step S-33, the temperature flag is detected. If the temperature flag is set to "1", that is, the supplied wash water exceeds 52° C., the program proceeds to the fuzzy process in the step S-31. On the other hand, if the temperature flag is "0", that is, the wash water is not more than 52° C., the washing operation is continued, to repeat the processing in the step S-24 and the subsequent steps.

If the fuzzy process is started, the pump 7 and the heater 4 are first turned off in the step S-34, and it is judged in the step S-35 whether or not one minute has elapsed since the pump 7 and the heater 4 were turned off, as shown in FIG. 8. If one minute has elapsed, the program proceeds to the step S-36. In the step S-36, the light transmittance of the wash water is detected in the transmittance detecting circuit 41. In the step S-37, the value detected in the step S-36 is stored in the buffer MD 45. Also in this case, the pump 7 and the heater 4 are temporarily turned off before the light transmittance of the wash water is detected in order to cause the bubbles in the wash water to disappear and cause the garbage or the like in the wash water to sink so that the light transmittance of the wash water is correctly detected.

Thereafter, the value MC stored in the buffer MC 44 and the value MD stored in the buffer MD 45 are compared with each other in the step S-38. Specifically, the voltage MC representing transmittance at the time when three minutes which are a predetermined short time period have elapsed since the washing operation was started (the actual washing time is two minutes) and the voltage MD representing transmittance at a certain time point after performing the washing operation for at least eight minutes are compared with each other. The value MD is stored in the buffer MF 47 in the step S-39 if MC>MD, while the value MC is stored in the buffer MF 47 in the step S-40 if MC≦MD. Specifically, the lower one of the voltage MC representing the transmittance at the time when a predetermined short time period has elapsed since the washing operation was started and the voltage MD representing the transmittance after performing the washing operation for a relatively long time period is stored as MF in the buffer MF 47 in the steps S-39 and S-40. Thereafter, the program proceeds to the step S-41.

In the step S-41, an initial value ME in the buffer ME 46 and the value MF (the lower one of MC and MD) in the buffer MF 47 are compared with each other.

If the voltage ME representing transmittance before starting the washing operation and the voltage MF representing the transmittance after performing the washing operation for a predetermined time period are compared with each other, the voltage MF after performing the washing operation is generally lower. The reason for this is that dirt on the dishes is mixed with the wash water by the washing operation, so that the transmittance of the wash water is lowered. Consequently, ME is generally higher than MF.

Accordingly, the amount of dirt is then calculated on the basis of the following equation (1) in the step S-42:

$$\textit{Amount of dirt} = MF \times (\textit{Reference voltage}/ME) \quad (1)$$

In the equation, "Reference voltage" means a voltage outputted from the transmittance detecting circuit 41 for the transmittance of 100% when the dish washing and drying machine is new, that is, 5V. The voltage ME is also 5V when the light receiving element 30 is not degraded as it is used, while being slightly lower than 5V if the light receiving element 30 is degraded. Therefore, the change with time of the light receiving element 30 is corrected by the foregoing equation (1).

The quality of dirt is then calculated by the following equation (2) in the step S-43.

$$\textit{Quality of dirt} = (MD - MC) \times (\textit{Reference voltage}/ME) \quad (2)$$

The quality of dirt is represented by the difference between the voltage MC at the time when a short time period has elapsed since the washing operation was started and the voltage MD after performing the washing operation for at least eight minutes. Also in this case, the ratio of the reference voltage to the initial detected voltage ME is multiplied so as to correct the change with time of the light receiving element 30.

Unless ME is higher than MF in the step S-41, the initial value ME may not be an accurate value because light is intercepted by, for example, garbage or the like, so that processing for correcting the change with time of the light receiving element 30 using the initial value ME and the reference voltage is not performed. In this case, the initial value ME is ignored, to determine the amount of dirt and the quality of dirt. Specifically, it is determined that the amount of dirt is MF and the quality of dirt is (MD−MC) in the steps S-44 and S-45. Thereafter, the program proceeds to fuzzy inference in the step S-46.

Figure 13:
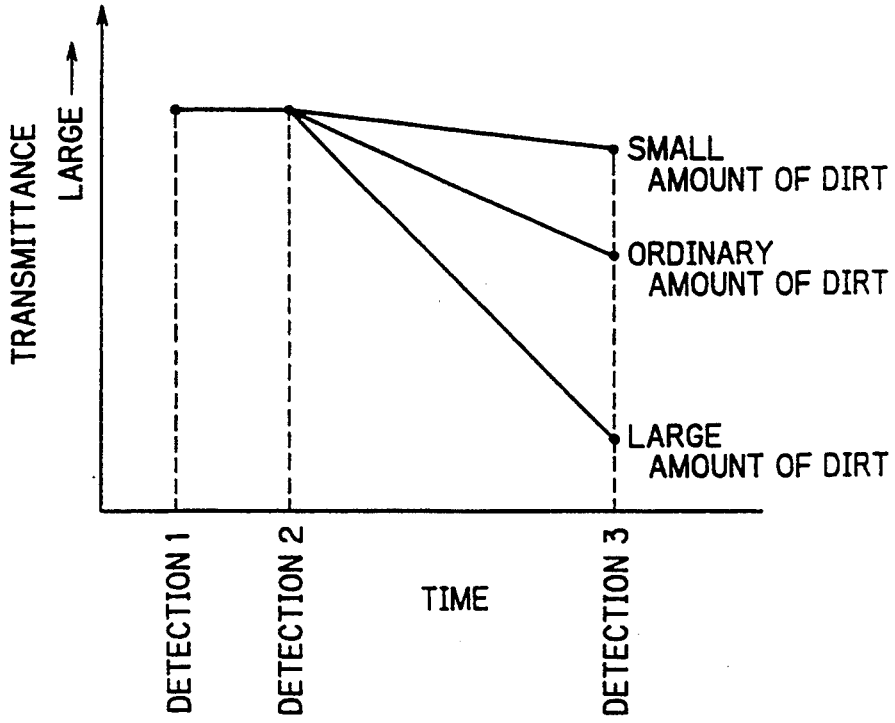
FIG. 13 is a diagram showing the relationship between the amount of dirt and the light transmittance of wash water.
Figure 14:
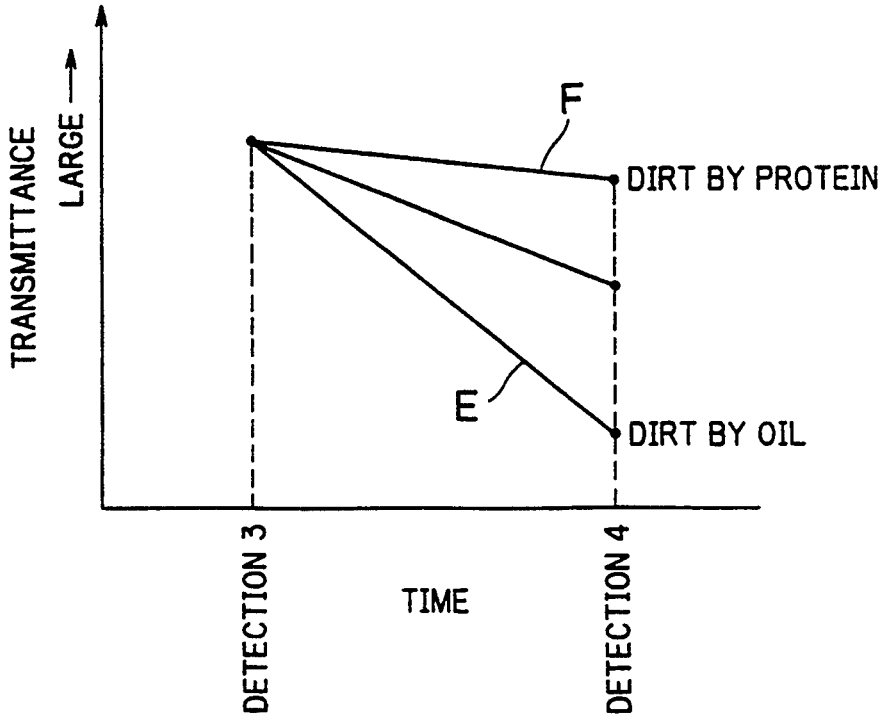
FIG. 14 is a diagram showing the relationship between the quality of dirt and the light transmittance of wash water.

The reason why the amount of dirt and the quality of dirt can be detected from the light transmittance of wash water will be described with reference to FIGS. 13 and 14. FIG. 13 is a diagram showing the relationship between the amount of dirt and the transmittance, and FIG. 14 is a diagram showing the relationship between the quality of dirt and the transmittance. In FIGS. 13 and 14, the time point where the transmittance is detected before the water is supplied is taken as detection 1 (data stored in the buffer MA 42), the time point where the transmittance is detected before the washing operation is started after the water supply is taken as detection 2 (data stored in the buffer MB 43), the time point where the transmittance is detected after three minutes have elapsed since the washing operation was started is taken as detection 3 (data stored in the buffer MC 44), and the time point where the transmittance is detected at the time of the fuzzy process is taken as detection 4 (data stored in the buffer MD 45).

When an output of the transmittance detecting circuit 41 is not affected by garbage or the like, both the detected values (the transmittance) MA and MB in the detection 1 and the detection 2 are approximately a reference voltage (for example, 5V). Thereafter, the washing operation is started.

Consider a case where the dishes are very dirty. In this case, if the washing operation is started to spray the wash water from the nozzle, much of dirt is dropped into the wash water, so that the wash water is frequently clouded. Accordingly, the transmittance in detection 3 is lowered. On the other hand, consider a case where the dishes are slightly dirty. In this case, the transmittance is slightly lower than that before the start of the washing operation. However, the wash water does not become so dirty, so that the transmittance is relatively high. Consequently, the transmittance obtained in the detection 3 shown in FIG. 13, that is, the output voltage of the transmittance detecting circuit 41 represents the amount of dirt.

Furthermore, if dirt is caused by oil, the oil must be first softened by warm water, so that a longer time is required to drop the dirt from the dishes. Consequently, the light transmittance of the wash water is further lowered in the detection 4 performed at the time point where a certain time period has elapsed since the detection 3, as compared with that in the detection 3 performed when a predetermined short time period has elapsed since the washing operation was started (see a straight line E). On the other hand, when dirt is caused by proteins other than the oil, much of the dirt is dropped at the time point where the detection 3 is performed, so that there is little difference between the transmittance in the detection 3 and the transmittance in the detection 4, to display characteristics represented by a straight line F. Specifically, it is judged that dirt is mainly stubborn dirt such as dirt by oil if the difference between the transmittance in the detection 3 and the transmittance in the detection 4 is large, while being mainly dirt by proteins other than dirt by oil if it is small.

Figure 15:
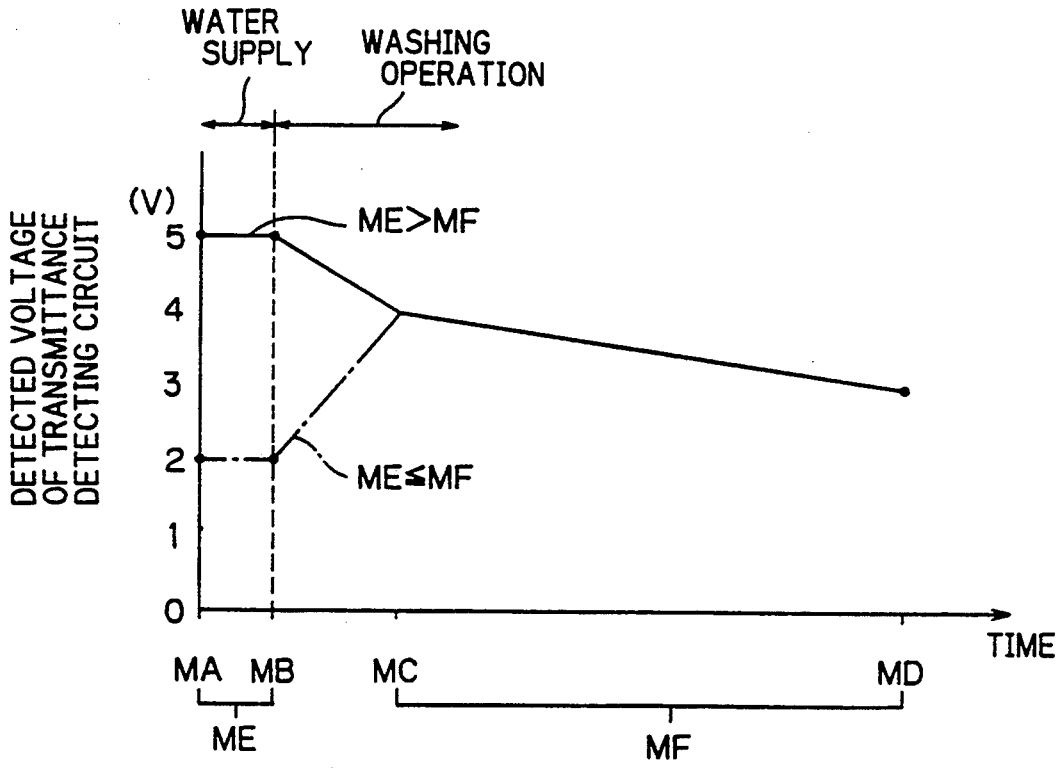
FIG. 15 is a graph showing the relationship between washing time and an output voltage of a transmittance detecting circuit 41.

Referring now to FIG. 15, description is made of a method of calculating the amount of dirt and the quality of dirt carried out in the steps S-42, S-43, S-44 and S-45.

In FIG. 15, the horizontal axis represents time, and the vertical axis represents an output voltage of the transmittance detecting circuit 41. The transmittance detecting circuit 41 outputs a voltage of 5V when the transmittance is 100%, and the outputted voltage is decreased as the transmittance is lowered. Unless light received by the light receiving element 30 is intercepted due to the effect of garbage or the like as described above, the transmittance is 100% and the output of the transmittance detecting circuit 41 is 5V before wash water is supplied and before the washing operation is started after the water supply. Thereafter, the detected value MC at the time when a predetermined short time period has elapsed since the washing operation was started is, for example, 4V, and the detected value MD at a predetermined time point after further performing the washing operation is, for example, 3V.

If the light emitting element 29 or the light receiving element 30 is degraded in performance due to the change with time, however, the output voltages MA and MB are not 5V but, for example, 4.7V to 4.8V even if the transmittance is 100%. In addition, the voltages MC and MD thereafter detected are relatively low (although the entire graph indicated by a solid line in FIG. 15 is to be shifted relatively downward in such case, it is not necessarily shifted by a predetermined amount as a whole). Accordingly, the value MC or MD cannot be directly used as a value indicating the amount of dirt. Therefore, the amount of dirt is found by correcting the value MF using the reference voltage "5V" and the initial detected voltage ME by the foregoing equation (1).

Similarly, the quality of dirt is corrected using the reference voltage "5V" and the initial detected voltage ME (see the equation (2)).

The amount of dirt and the quality of dirt are as follows if they are concretely represented by the voltages using the graph shown in FIG. 5:

$$\begin{aligned} \text{Amount of dirt} &= MD \times (\text{Reference voltage}/ME) \\ &= 3 \times (5/5) = 3\ (V) \\ \text{Quality of dirt} &= (MD - MC) \times (\text{Reference voltage}/ME) \\ &= (3\text{–}4) \times (5/5) = -1\ (V) \end{aligned}$$

On the other hand, a case where ME is not higher than MF in the step S-41 shown in FIG. 8 is a case where the initial detected voltage takes a value which cannot be trusted due to garbage or the like. Specifically, it is a case indicated by a one-dot and dash line in FIG. 15. In such a case, the value ME is not used considering that it is erroneous, to find the amount of dirt and the quality of dirt using the values MC and MD which are actually detected. In this case, therefore, the degradation of the light receiving element 30 and the like due to the change with time is not corrected.

Figure 16:
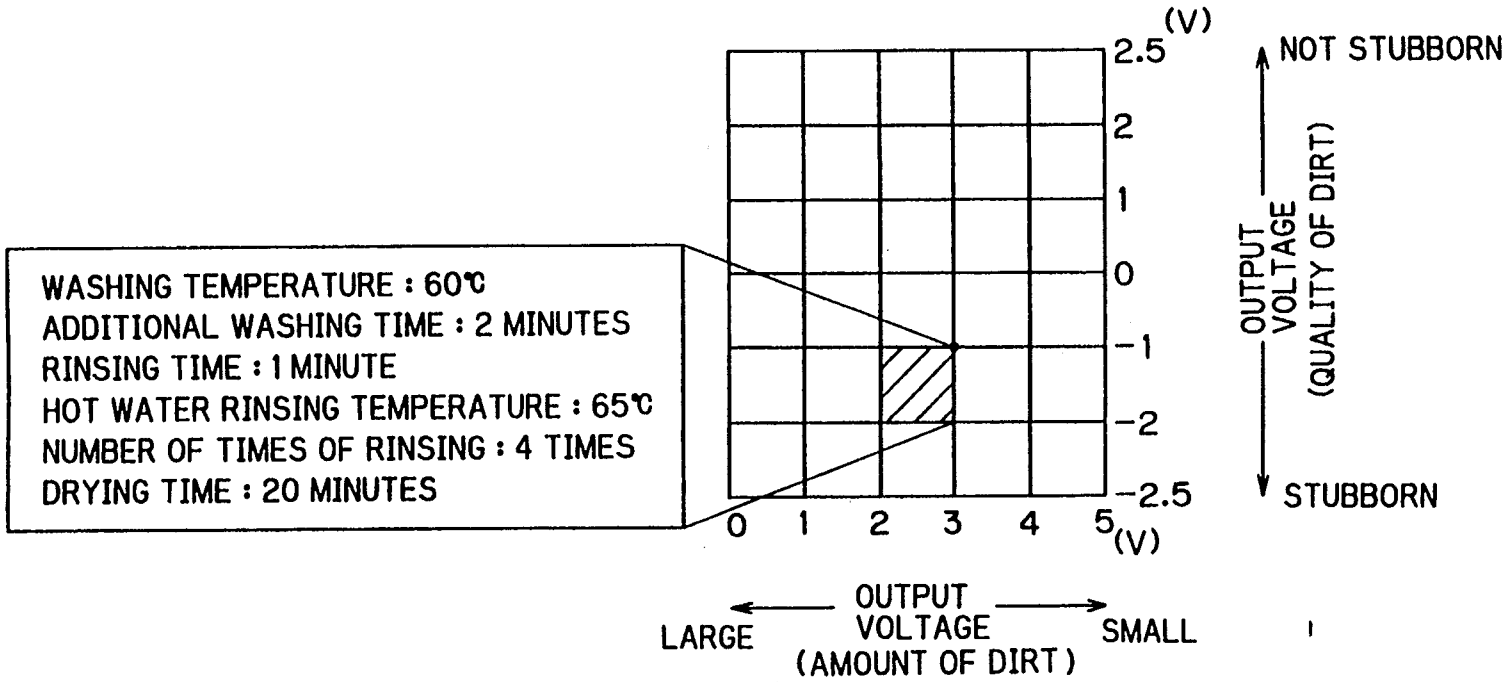
FIG. 16 is an illustration useful for explaining a fuzzy (logic) look-up table previously set.

In the step S-46 shown in FIG. 8, the amount of dirt and the quality of dirt which are calculated in the above described steps S-42 and S-43 or the amount of dirt and the quality of dirt which are calculated in the steps S-44 and S-45 are then applied to a fuzzy look-up table shown in FIG. 16, to determine the contents of control in the additional washing process, the rinsing process, the hot water rinsing process, and the drying process.

In the fuzzy look-up table shown in FIG. 16, an output voltage representing the amount of dirt is used to enter the horizontal axis and an output voltage representing the quality of dirt is used in the vertical axis, and a washing temperature, additional washing time, rinsing time, a hot water rinsing temperature, the number of times of rinsing, and drying time are previously set for each block. Therefore, the above described voltages representing the amount of dirt and the quality of dirt which are calculated are applied to the look-up table, thereby to make it possible to obtain the contents of control required. In this concrete example, the amount of dirt is represented by 3V, and the quality of dirt is represented by −1V. Accordingly, the contents of control described in a block indicated by hatching are read out as the contents of control thereafter required.

Figure 17:
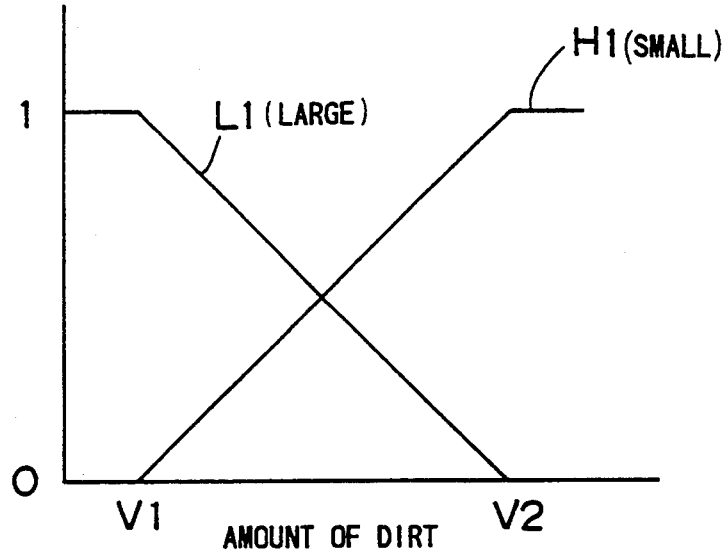
FIG. 17 is a diagram showing fuzzy membership functions related to the amount of dirt.
Figure 18:
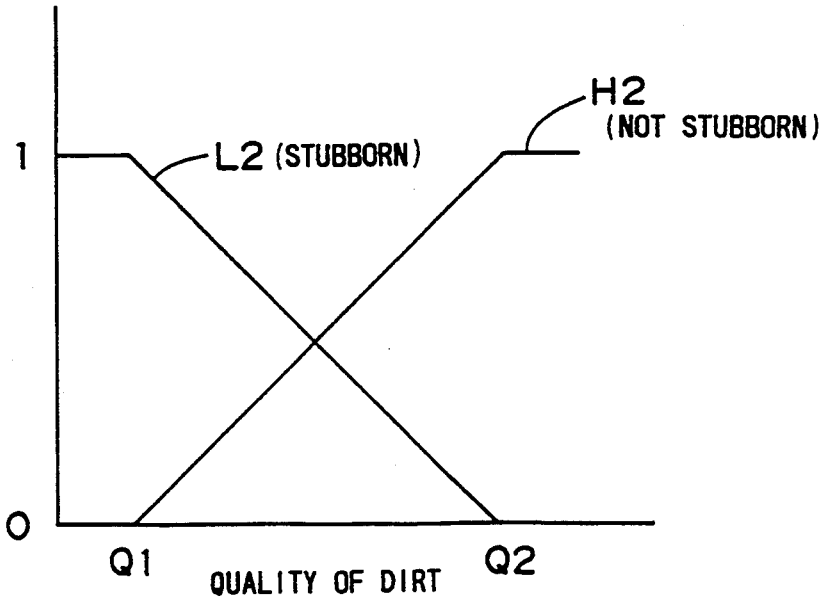
FIG. 18 is a diagram showing fuzzy membership functions related to the quality of dirt.

The contents of control set in the fuzzy look-up table shown in FIG. 16 are predetermined by executing fuzzy inference on the basis of membership functions shown in FIGS. 17 and 18 and a fuzzy rule shown in Table 1.

Description is now made of membership functions. In FIG. 17, a label L1 is a membership function with respect to "the amount of dirt is large", and a label H1 is a membership function with respect to "the amount of dirt is small". If the voltage representing the amount of dirt is less than V1, the degree belonging to the label L1 is 1 (100%). However, if the voltage representing the amount of dirt is from V1 to V2, the degree belonging to the label L1 is gradually decreased from 1 to 0 as the amount of dirt is decreased. If the voltage representing the amount of dirt is not less than V2, the degree belonging to the label L1 becomes 0. On the other hand, if the voltage representing the amount of dirt is less than V1, the degree belonging to the label H1 is 0, and the degree belonging to the label H1 is increased from 0 to 1 as the amount of dirt is decreased. If the voltage representing the amount of dirt is not less than V2, the degree belonging to the label H1 is 1.

Furthermore, in FIG. 18, a label L2 is a membership function with respect to "the quality of dirt is large (dirt is stubborn)", and a label H2 is a membership function with respect to "the quality of dirt is small (dirt is not stubborn)". If the voltage representing the quality of dirt is less than Q1, the degree belonging to the label L2 is 1 (100%). However, if the voltage representing the quality of dirt is from Q1 to Q2, the degree belonging to the label L2 is gradually decreased from 1 to 0 as the voltage representing the quality of dirt is changed from Q1 to Q2. If the voltage representing the quality of dirt is not less than Q2, the degree belonging to the label L2 is 0. On the other hand, if the voltage representing the quality of dirt is less than Q1, the degree belonging to the label H2 is 0, and the degree belonging to the label H2 is increased from 0 to 1 as the voltage representing the quality of dirt is changed from Q1 to Q2. If the voltage representing the quality of dirt is not less than Q2, the degree belonging to the label H2 is 1.

TABLE 1

| | IF | | THEN | | | | |
|---|---|---|---|---|---|---|---|
| rule | amount of dirt | quality of dirt | additional washing temperature | additional washing time | rinsing time | hot water rinsing temperature | drying time |
| ① | large | small | slightly high | slightly long | short | medium | slightly short |
| ② | large | large | very high | long | long | high | short |
| ③ | small | small | low | very short | short | low | long |

TABLE 1-continued

| | IF | | THEN | | | | |
|---|---|---|---|---|---|---|---|
| rule | amount of dirt | quality of dirt | additional washing temperature | additional washing time | rinsing time | hot water rinsing temperature | drying time |
| ④ | small | large | medium | medium | medium | high | short |

Description is now made of the fuzzy rule shown in Table 1. In a rule (1), if the amount of dirt is large and the quality of dirt is small, then the additional washing temperature is made slightly higher, the additional washing time is made slightly longer, the rinsing time is made shorter, the hot water rinsing temperature is made medium, and the drying time is made slightly shorter. In the rule (2), if both the amount of dirt and the quality of dirt are large, then the additional washing temperature is made very high, the additional washing time is made long, the rinsing time is made long, the hot water rinsing temperature is made high, and the drying time is made short. In the rule (3), if both the amount of dirt and the quality of dirt are small, then the additional washing temperature is made low, the additional washing time is made very short, the rinsing time is made short, the hot water rinsing temperature is made low, and the drying time is made long. In the rule (4), if the amount of dirt is small and the quality of dirt is large, then the additional washing temperature, the additional washing time and the rinsing time are made medium, the hot water rinsing temperature is made high, and the drying time is made short.

The degrees belonging to the label L1 and the label H1 in FIG. 17 and the degrees belonging to the label L2 and the label H2 in FIG. 18 are applied to the fuzzy rule shown in Table 1 as input data, and an inference operation of the input data is performed using a center of gravity method, to calculate the contents of control such as the additional washing temperature and the additional washing time with respect to various amounts and qualities of dirt. The results are set in the fuzzy look-up table (see FIG. 16).

Referring to FIG. 8 again, it is then judged in the step S-47 whether or not the local power source operating frequency is, for example, 50 Hz after the sequence of washing, rinsing and drying is determined. Japan is taken as an example. The frequency of the commercial power supply is 50 Hz in the east Japan, while being 60 Hz in the west Japan. In the present embodiment, the frequency of the commercial power supply is judged so that the dish washing and drying machine can be normally operated irrespective of the difference in frequency of the commercial power supply between the areas where it is used. If the operating frequency is 60 Hz, the program proceeds to the step S-49. On the other hand, if the operating frequency is 50 Hz, the additional washing temperature determined in the step S-46 is corrected to a temperature higher by a predetermined value (for example, 1 to 5 degrees) in the step S-48 and then, the program proceeds to the step S-49. In the step S-49, the additional washing time is corrected to time shorter and the hot water rinsing temperature is corrected to a temperature lower depending on the water temperature on the basis of a correction rule shown in Table 2.

TABLE 2

| water temperature | additional washing time | hot water rinsing temperature (only when it is set to not less than 68° C.) |
|---|---|---|
| not less than 15° C. | 0 min | 0° C. |
| 15° C.~ 10° C. | −1 min | −2° C. |
| less than 10° C. | −2 min | −3° C. |

Specifically, if the water temperature is 15° to 10° C., the washing time is corrected to time shorter by one minute, and the hot water rinsing temperature is corrected to a temperature lower by two degrees. If the water temperature is less than 10° C., the washing time is corrected to time shorter by two minutes, and the hot water rinsing temperature is corrected to a temperature lower by three degrees. If the water temperature is not less than 15° C., both the washing time and the hot water rinsing temperature are not corrected. In addition, it is only when the water temperature is set to not less than 68° C. in the step S-46 that the hot water rinsing temperature is corrected. If this correction is terminated, the program proceeds to the step S-50. In the step S-50, the additional washing process shown in FIG. 9 is carried out. The reason why the lower the water temperature is, the shorter the additional washing time is made in the correction in the step S-49 is that the lower the temperature of wash water first supplied is, the longer time required until the wash water reaches a temperature suitable for washing, for example, 52° C. is, and the longer a time period during which the washing operation is performed is.

Figure 10:
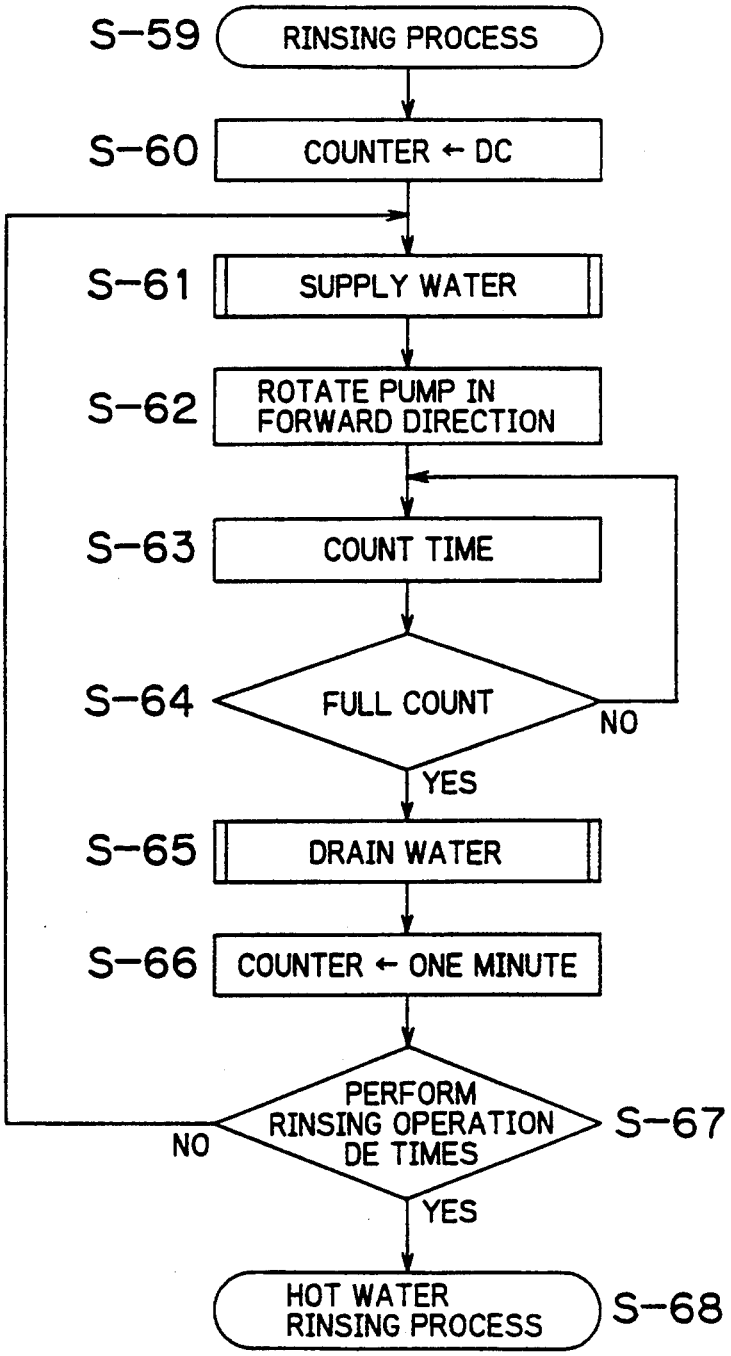
FIG. 10 is a flow chart showing operations in the rinsing process in the dish washing and drying machine according to one embodiment of the present invention.

In the additional washing process, the pump 7 is first rotated in the forward direction and the heater 4 is turned on in the step S-51. Thereafter, the temperature of the wash water is detected in the step S-52, and it is judged in the step S-53 whether or not the temperature reaches an additional washing temperature DA. If the wash water reaches the additional washing temperature DA, the program proceeds to the step S-54. As a result, additional washing time DB is set in the counter 50, and the time is counted in the step S-55. The additional washing is continued until the counter 50 reaches the full count. When the counter 50 reaches the full count in the step S-56, the pump 7 is stopped and the heater 4 is turned off in the step S-57. The pump 7 is rotated in the reverse direction to start the drainage in the step S-58. If the drainage is terminated, the program proceeds to the step S-59. In the step S-59, the rinsing process shown in FIG. 10 is carried out.

In the rinsing process, rinsing time DC is first set in the counter 50 in the step S-60 and then, the water supply is started in the step S-61. If a predetermined amount of wash water is supplied, the washing and drainage pump 7 is rotated in the forward direction in the step S-62, to start the rinsing operation. Subsequently, the time is counted in the step S-63. If it is judged in the step S-64 that the counter 50 reaches the full count, the program proceeds to the step S-65. In the step S-65, the pump 7 is rotated in the reverse direction, so that rinsing water in the cavity 1 is drained. Thereafter, rinsing time of one minute is set in the counter 50 in the step S-66. As a result, the rinsing operation has been performed once. If it is judged in the step S-67 that the rinsing operation is performed the number of times DE which is found in the fuzzy inference in the step S-46, the program proceeds to the step S-68. In the step S-68, the hot water rinsing process shown in FIG. 11 is carried out.

In the hot water rinsing process, a predetermined amount of rinsing water is first supplied to the cavity 1 in the step S-69. Thereafter, the pump 7 is rotated in the forward direction and the heater 4 is turned on in the step S-70, to heat the rinsing water. The temperature of the rinsing water is detected in the step S-71. If the rinsing water reaches a hot water rinsing temperature DD in the step S-72, hot water rinsing time of "three minutes" is set in the counter 50 in the step S-73, and the time is counted in the step S-74. If the counter 50 counts the time set in the step S-73 up in the step S-75, the heater 4 is turned off and the washing and drainage pump 7 is rotated in the reverse direction in the step S-76, and the rinsing water in the cavity 1 is drained in the step S-77. Thereafter, the program proceeds to the step S-78. In the step S-78, the drying process shown in FIG. 12 is carried out.

In the drying process, drying time DF is first set in the counter 50 in the step S-79 and then, the heater 4 and the motor 24 for rotating the double faced fan 16 are turned on in the step S-80. In the steps S-80 through S-86, on-off control of the heater 4 is so carried out that the temperature in the cavity 1 is maintained at 65° C. and the double faced fan 16 is rotated by the motor 24 until the counter 50 reaches the full count. Consequently, air in the cavity 1 is dehumidified, so that dried air is sent to the dishes to dry the dishes. If the counter 50 reaches the full count in the step S-86, the heater 4 and the motor 24 are turned off in the step S-87, and the drying process is terminated in the step S-88.

The above described dish washing and drying machine thus controls the sequence of washing, rinsing and drying by the fuzzy inference so that the washing time is lengthened if the dishes are very dirty, the temperature of the wash water is increased if the dishes are very dirty due to oily dirt, and the washing time is shortened if the dishes are only slightly dirty, depending on data representing the quality of dirt judging from the difference between transmittance in the early stages of washing and transmittance after at least a predetermined time period and data representing the amount of dirt judging from transmittance during the washing process, thereby to make it possible to do washing conforming to dirt to improve the washing.

Furthermore, the sequence is determined by the fuzzy inference and then, such correction is made that the additional washing time is shorter by one to two minutes and the hot water rinsing temperature is lower by two to three degrees depending on the water temperature, and a mechanical force of the pump 7 is exerted to do washing. Accordingly, there is little difference in detergency between the finished dishes in, for example, a case where the water temperature in winter is low, thereby to make it possible to shorten the total operating time because the additional washing time and the hot water rinsing temperature are corrected.

Additionally, in a case where the frequency of the commercial power supply is 50 Hz, such correction is made that the additional washing temperature determined by the fuzzy inference is higher than the temperature in a case where it is 60 Hz by one to five degrees, thereby to make it possible to compensate for the decrease in the capability of the pump, eliminating the possibility that the detergency differs depending on the frequency of the commercial power supply. It goes without saying that such control may be omitted if the frequency of the commercial power supply is constant.

Although description was made by taking as an example a dish washing and drying machine, the present invention is also applicable to a dish washing machine having no drying function.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A dish washing machine comprising:

a cavity for containing dishes;

water supplying means for supplying wash water to said cavity;

heating means for heating the wash water supplied to said cavity;

a nozzle for spraying the wash water on said dishes;

water feeding means for feeding into said nozzle the wash water supplied to said cavity to spray the wash water from the nozzle;

transmittance detecting means for detecting light transmittance of the wash water supplied to said cavity; and control means for controlling, on the basis of the light transmittance of the wash water detected by said transmittance detecting means, said control being based on a first transmittance detected before said water feeding means is operated to start the washing operation, a second transmittance detected when a predetermined time period has elapsed after the start of the washing operation, and a third transmittance detected at a predetermined time after an elapse of said predetermined time period during the washing operation, wherein a sequence of washing and rinsing is determined after detecting the third transmittance.

2. The dish washing machine according to claim 1, wherein said control means determines an amount of dirt on said dishes on the basis of a lower of the second transmittance and the third transmittance, and determines the quality of dirt on said dishes on the basis of a difference between said second transmittance and said third transmittance.

3. The dish washing machine according to claim 2, wherein said control means determines a washing cycle depending on the amount of dirt and the quality of dirt on the dishes based on said first transmittance.

4. The dish washing machine according to claim 2, further comprising temperature detecting means for detecting the temperature of the wash water supplied to said cavity by said water supplying means, said control means controlling at least one of a washing time, rinsing time or heating time required to heat the wash water used for rinsing by said heating means on the basis of the temperature detected by said temperature detecting means.

5. The dish washing machine according to claim 2, further comprising a drying heater for increasing the temperature in said cavity and blowing means so as to dry said dishes which have been washed and rinsed, and wherein said control means controls said drying heater and said blowing means on the basis of said first transmittance, said second transmittance and said third transmittance.

6. The dish washing machine according to claim 5, wherein the heating means for heating the wash water is used as said drying heater.

7. The dish washing machine according to claim 1, further comprising a drying heater for increasing the temperature in said cavity and blowing means so as to dry said dishes which have been washed and rinsed, and wherein said control means controls said drying heater and said blowing means on the basis of said first transmittance, said second transmittance and said third transmittance.

8. The dish washing machine according to claim 7, wherein the heating means for heating the wash water is used as said drying heater.

9. A dish washing machine comprising:

a cavity for containing dishes;

water supplying means for supplying wash water to said cavity;

heating means for heating the wash water supplied to said cavity;

a nozzle for spraying the wash water on said dishes;

water feeding means for feeding into said nozzle the wash water supplied to said cavity and to spray the wash water from the nozzle;

transmittance detecting means for detecting light transmittance of the wash water supplied to said cavity;

reading means for reading the light transmittance of the wash water detected by said transmittance detecting means at a first time before said water feeding means is operated to start the washing operation, at a second time when a predetermined short time period has elapsed after the water feeding means is operated to start the washing operation, and at a predetermined third time after said second time;

operation stopping means for stopping feeding of the wash water by said water feeding means before the light transmittance of the wash water detected by said transmittance detecting means is read by said reading means; and control means for controlling, on the basis of the light transmittance read by said reading means, said control being based on a first transmittance read at the first time before the washing operation is started, a second transmittance read at the second time when a predetermined short time period has elapsed since the washing operation was started, and third transmittance read at the third time a predetermined time point after an elapse of said predetermined short time period, the sequence of washing and rinsing after detecting third transmittance.

10. The dish washing machine according to claim 9, wherein said reading means reads the light transmittance after a predetermined time period has elapsed after the water feeding means has been stopped from feeding the wash water by said operation stopping means.

11. The dish washing machine according to claim 10, wherein said predetermined time period is a time period required for bubbles formed in the wash water to disappear and debris which is suspended in the wash water to sink.

12. The dish washing machine according to claim 11, wherein said predetermined time period is approximately one minute.

13. The dish washing machine according to claim 10, further comprising a drying heater for increasing the temperature in said cavity and blowing means so as to dry the dishes which have been washed and rinsed, said control means controlling said drying heater and said blowing means on the basis of said transmittance, said second transmittance and said third transmittance.

14. The dish washing machine according to claim 13, wherein the heating means for heating the wash water is used as said drying heater.

15. The dish washing machine according to claim 9, wherein said control means determines an amount of dirt of said dishes on the basis of the lower of the second transmittance and third transmittance, and determines the quality of dirt on said dishes on the basis of the difference between said second transmittance and third transmittance.

16. The dish washing machine according to claim 15, wherein said control means determines a washing cycle depending on the amount of dirt and the quality of dirt on the dishes based on said first transmittance.

17. The dish washing machine according to claim 15, further comprising a drying heater for increasing a temperature in said cavity and blowing means so as to dry the dishes which have been washed and rinsed, said control means controlling said drying heater and said blowing means on the basis of said first transmittance, said second transmittance and said third transmittance.

18. The dish washing machine according to claim 17, wherein the heating means for heating the wash water is used as said drying heater.

19. The dish washing machine according to claim 9, further comprising a drying heater for increasing a temperature in said cavity and blowing means so as to dry the dishes which have been washed and rinsed, said control means controlling said drying heater and said blowing means on the basis of said first transmittance, said second transmittance and said third transmittance.

20. The dish washing machine according to claim 19, wherein the heating means for heating the wash water is used as said drying heater.

* * * * *